US010238179B2

(12) United States Patent
Suzuki

(10) Patent No.: US 10,238,179 B2
(45) Date of Patent: Mar. 26, 2019

(54) SHOE

(71) Applicant: Sota Suzuki, Tokyo (JP)

(72) Inventor: Sota Suzuki, Tokyo (JP)

( * ) Notice: Subject to any disclaimer, the term of this patent is extended or adjusted under 35 U.S.C. 154(b) by 0 days.

(21) Appl. No.: 15/171,248

(22) Filed: Jun. 2, 2016

(65) Prior Publication Data

US 2016/0270479 A1 Sep. 22, 2016

Related U.S. Application Data

(63) Continuation-in-part of application No. PCT/JP2014/082172, filed on Dec. 4, 2014.

(30) Foreign Application Priority Data

Dec. 4, 2013 (JP) ..... 2013-250955

(51) Int. Cl.
*A43B 7/14* (2006.01)
*A43B 23/02* (2006.01)
(Continued)

(52) U.S. Cl.
CPC ..... *A43B 23/029* (2013.01); *A43B 5/0407* (2013.01); *A43B 7/146* (2013.01);
(Continued)

(58) Field of Classification Search
CPC ..... A43B 7/146; A43B 23/029; A43B 23/028; A43B 23/0285
(Continued)

(56) References Cited

U.S. PATENT DOCUMENTS 1,257,086 A * 2/1918 Marcellus ..... A43B 7/02 36/141
3,410,004 A 11/1968 Finn
(Continued)

FOREIGN PATENT DOCUMENTS

CA 2312676 A1 12/2001
CA 2510907 A1 12/2005
(Continued)

OTHER PUBLICATIONS

International Search Report of PCT/JP2014/082172 dated Mar. 10, 2015 published in WO 2015/083810.
(Continued)

*Primary Examiner* — Marie D Bays
(74) *Attorney, Agent, or Firm* — Manatt, Phelps & Phillips, LLP

(57) ABSTRACT

The present invention relates to a shoe, and in order to provide a shoe excellent in convenience, easy to put on and take off, inexpensive, light-weight, comfortable to wear, promoting health and exhibiting excellent extensibility, the easily wearable shoe according to the present invention is characterized by the shapes of an outer layer and inner sacs corresponding to various body organs, additionally including a shoe outer layer, sacs of a stretchable material joined mainly inside the outer layer, and an intake inlet/outlet that is formed of a valve that takes in and discharges an air-like gas into/from the sacs, facilitating the insertion of a foot by injecting the gas from the intake inlet/outlet into the sacs and causing the sacs and the shoe outer layer to be flexible, discharging the gas from the intake outlet so as to cause the shoe outer cover and the sacs to contract and come into close contact with the foot, being capable of freely setting an effect from the shoe on a body organ due to the shapes of the outer layer and the inner sacs corresponding to various body
(Continued)

organs, and being capable of effectively extending the functions of the shoe.

2 Claims, 7 Drawing Sheets

(51) Int. Cl.
*A43B 11/00* (2006.01)
*A61H 39/04* (2006.01)
*A43B 5/04* (2006.01)

(52) U.S. Cl.
CPC ..... *A43B 11/00* (2013.01); *A43B 23/0205* (2013.01); *A61H 39/04* (2013.01); *A61H 2201/164* (2013.01); *A61H 2201/165* (2013.01); *A61H 2201/168* (2013.01); *A61H 2201/1695* (2013.01); *A61H 2205/12* (2013.01)

(58) Field of Classification Search
USPC ..... 36/88, 45, 29, 141
See application file for complete search history.

(56) References Cited

U.S. PATENT DOCUMENTS 3,685,176 A 8/1972 Rudy
3,760,056 A 9/1973 Bogert
3,871,117 A * 3/1975 Richmond ..... A43B 17/035 36/29
3,888,242 A * 6/1975 Harris ..... A61H 9/0078 36/141
4,864,738 A * 9/1989 Horovitz ..... A43B 13/206 2/413
5,113,850 A * 5/1992 Larremore ..... A43B 3/00 601/136
5,343,638 A * 9/1994 Legassie ..... A43B 3/0005 36/28
5,400,526 A * 3/1995 Sessa ..... A43B 1/0045 36/141
5,784,807 A * 7/1998 Pagel ..... A43B 1/0009 36/153
5,806,208 A * 9/1998 French ..... A43B 7/02 36/28
6,170,173 B1 * 1/2001 Caston ..... A43B 13/203 36/141
6,195,914 B1 * 3/2001 Otis ..... A43B 3/105 36/11.5
6,434,859 B1 * 8/2002 Kim ..... A43B 7/142 36/141
6,718,656 B2 * 4/2004 Houser ..... A43B 7/1415 36/88
6,766,599 B2 * 7/2004 Baek ..... A43B 5/0407 2/DIG. 3
7,131,220 B1 * 11/2006 Richey ..... A43B 5/0407 36/29
7,204,041 B1 * 4/2007 Bailey, Sr. ..... A43B 3/0005 36/1
7,264,599 B1 * 9/2007 Milligan ..... A43B 3/0005 36/141
7,337,560 B2 * 3/2008 Marvin ..... A43B 13/20 36/29
7,472,496 B2 * 1/2009 Potter ..... A43B 13/143 36/29
7,513,067 B2 * 4/2009 Marvin ..... A43B 1/0072 36/29
7,735,241 B2 * 6/2010 Marvin ..... A43B 13/20 36/29
8,151,489 B2 * 4/2012 Marvin ..... A43B 13/20 36/29
2005/0288610 A1 12/2005 Park
2006/0185196 A1 * 8/2006 Wang ..... A43B 7/146 36/141
2006/0213091 A1 * 9/2006 Ometto ..... A43B 7/081 36/141
2006/0217638 A1 9/2006 Park
2013/0227857 A1 * 9/2013 Schindler ..... A43B 13/20 36/83

FOREIGN PATENT DOCUMENTS

CH 539402 A 7/1973
CN 1714693 A 1/2006
CN 201683114 U 12/2010
DE 2122907 A 1/1972
DE 102008032832 A1 2/2010
EP 1611874 A1 1/2006
FR 2098148 A 3/1972
FR 258194 A1 11/1986
GB 1355711 A 6/1974
GB 1355712 A 6/1974
JP 52-41700 B1 10/1977
JP 62-249601 A 10/1987
JP 11-90064 A 4/1999
JP 11-197201 A 7/1999
JP 2000-70001 A 3/2000
JP 2006-6945 A 1/2006
JP 2006-187356 A 7/2006
JP 2007-537798 A 12/2007
JP 2009-178446 A 8/2009
KR 10-2006-0044427 A 5/2006

OTHER PUBLICATIONS

The Extended European Search Report issued by the European Patent Office dated Jun. 21, 2017 for the European counterpart Application No. 14867218.1.
First Office Action issued by the State Intellectual Property Office of the People's Republic of China dated Aug. 16, 2017 to the Chinese counterpart Application No. 201480066026.4.
Second Office Action issued by the State Intellectual Property Office of the People's Republic of China dated May 9, 2018 to the Chinese counterpart Application No. 201480066026.4.
Third Office Action issued by the State Intellectual Property Office of the People's Republic of China dated Dec. 17, 2018 to the Chinese counterpart Application No. 201480066026.4.

* cited by examiner

SHOE

RELATED APPLICATIONS

This application is a continuation-in-part application of, and claims priority to, PCT application number PCT/JP2014/082172 filed on Dec. 4, 2014 (International Publication number WO2015/083810), which claims priority to JP2013-250955 filed on Dec. 4, 2013, all of which are hereby incorporated by reference.

TECHNICAL FIELD

The present invention relates to a shoe, and more particularly, to a shoe excellent in convenience, easy to put on and take off, rich in fitness, providing low air resistance and light weight, and excellent in extensibility.

BACKGROUND ART

As seen in Patent Literature 1 and Patent Literature 2, techniques of shoes are conventionally known which take in air inside a shoe and cause an outer layer of the shoe and the foot to come into close contact with each other to improve sensitivity of the sense of touch.

CITATION LIST

Patent Literature

Patent Literature 1: Japanese Unexamined Patent Application Publication No. 2007-537798

Patent Literature 2: Japanese Patent Application Laid-Open No. 62-249601. All of the above patent literatures are incorporated herein by reference in their entirety.

SUMMARY OF INVENTION

Technical Problem

Boots that fit by an intake operation described in Patent Literature 1 above are almost exclusively boots used under water and a technical idea disclosed therein is that air or water between an outer layer made of a flexible material and a foot inserted therein is taken in, and the foot and the outer layer are thereby caused to come into close contact with each other.

However, in the case where the outer layer is thin, even when the air between the outer layer and the foot is taken in, the texture of the outer layer after the intake is deviated and extra creases are also produced, and the wearing comfort is assumed to deteriorate. On the other hand, if the outer layer is thickened to overcome the deviation in the texture, the whole shoe becomes heavy and hard, and the wearing comfort seems to deteriorate after all. Thus, using this technical idea on land is not so realistic.

With vacuum contract ski shoes described in Patent Literature 2, such a technical idea is disclosed that a sheath is placed between a hard outer layer and a foot inserted therein, air therebetween is taken in to create vacuum and cause the foot and outer layer to come into close contact with each other.

However, considering that there is a sheath in close contact with the foot inside the shoe, which makes it hard to put on the shoe as is, it is necessary to unlatch the hard outer layer, open the outer layer and then insert the foot, latch the outer layer and then take in the air, which can be considered as a technical idea that focuses on how to firmly fasten the foot rather than the ease of putting on/taking off the shoe.

Shoes which are fastened to the foot using a lace or planar fastener or the like are conventionally known, but this produces air resistance and requires time and effort to lace up the shoes or use adhesion by tape or the like, resulting in a problem that it is not optimum for sports or the like.

The present invention has been implemented to solve the above-described problems of the prior arts, and configures base parts associated with a shoe structure in the form corresponding to organs including at least one of the muscle, skeletal frame, blood vessel, nerve, meridian, reflexology, endocrine organ and other body organs of the foot from the beginning. Here, the "base parts associated with the shoe structure" is a concept including the skeletal frame, outer layer and/or inner sacs of the structure. This minimizes the worsening of wearing comfort due to a deviation of texture after the intake of air first. In addition, it is an object of the present invention to provide a shoe easy to put on and take off and an easily wearable shoe in particular by taking-in/discharging an air-like gas into/from sacs inside the shoe.

Solution to Problem

In order to attain the above-described objects, the basic structure of the shoe is configured in the form corresponding to organs including at least one of the muscle, skeletal frame, blood vessel, nerve, meridian, reflexology, endocrine organ and other body organs of the foot from the beginning. This makes it possible to minimize the worsening of wearing comfort due to a deviation of texture or the like after taking in the air inside the shoe, provide excellent wearing comfort and achieve weight saving.

In addition, the shoe is configured of an outer layer of the shoe that covers the foot and sacs mainly made of a stretchable material provided with a gas intake/discharge valve disposed and joined mainly inside the outer layer so as to be stretched out to facilitate insertion of the foot, in which when the gas intake/discharge valve is opened to remove the air therein, the stretchable sacs contract and the gas is discharged from the sacs, and the outer layer and the sacs come into close contact with the foot.

The outer layer of the shoe may preferably have stretchability, and can be suitably implemented using all kinds of materials having water-proof properties, water repellent properties or properties of hardly allowing air to pass from outside to inside. The outer layer can also be implemented using, for example, hydro seal laminate, polyester lip Dermizax or action pile wind stopper. With such material properties, it is possible to keep high functionalities such as durability, sweat absorbency, moisture permeability, and thereby provide an outer layer applicable in all seasons.

By discharging/taking-in air or any given gas from/into the sacs disposed and joined to the outer layer mainly inside the shoe from outside or using a simple instrument such as a pump or dropper or a small gas bomb integrated with the shoe, it is possible to provide the entire shoe with flexibility, stretch out the outer layer and facilitate the insertion of the foot. The same procedure may also be performed to undo the close contact between the foot and the shoe.

An intake inlet/outlet is provided for the shoe, provided with an intake/discharge valve capable of taking-in/discharging the gas, and provided on the outer layer or the instep of the shoe and integrated with the shoe. The above-described intake/discharge valve is provided at the intake inlet/outlet and intended to prevent unintentional taking-in/discharging of the air.

Furthermore, a simple instrument such as a pump or dropper having the function of injecting or discharging the air into/from the instrument is connected to or integrated in advance with the intake/discharge valve provided at the above-described intake inlet/outlet, and it is thereby possible to inject the air into the shoe or discharge the air to the outside.

Taking advantage of the features of the low air resistance, absence of encumbering laces, being easy to put on and take off, the shoe in the above-described configuration is effectively applicable to various sports fields such as running shoes for track and field sports, soccer shoes, wrestling shoes, free climbing shoes, ski shoes, snowboard shoes, skating shoes, roller skating shoes or cycling shoes.

With the above-described configuration, the air is taken in into the sacs, with the interior of which the outer layer of the shoe is integrated, the whole shoe is thereby stretched out with flexibility, which facilitates putting on of the shoe, and after the foot is inserted, the intake/discharge valve is opened to remove the air, the injected gas is discharged through contraction of the sacs, and the sacs together with the outer layer of the shoe come into close contact with the foot, which can be used without slippage. That is, instead of causing the shoe and the foot to come into close contact with each other using laces or zippers as in the case of the prior arts, an air-like gas is taken in/discharged into/from the inside of the shoe to facilitate putting on/taking off the shoe, and since there are no laces or zippers in particular, the shoe provides excellent functionality, saves time and effort required to retie the laces or close the zippers, thus providing excellent convenience, low air resistance and light-weight properties.

This can secure the functionality resulting from preventing untying of the laces, thereby provide ease of putting on the shoe and provide convenience from the standpoint of allowing the shoe to come into close contact with the foot by a single gas discharge. Furthermore, it is also possible to save time and effort required to retie the laces.

Furthermore, such a configuration makes it possible to take in/discharge the air from inside or outside the shoe using a method excellent in convenience by connecting or integrating in advance a simple instrument such as a pump or dropper having the function of injecting or discharging the air into the instrument to/with the intake inlet provided with the intake/discharge valve.

That is, when putting on the shoe, air is taken in/discharged into/from the sacs in the shoe using such a simple instrument with the foot being inserted into the shoe body, the sacs and the outer layer are thereby provided with flexibility, making it possible to freely move the texture or the like, simply insert the foot into shoe, and discharge the gas from the sacs and cause the shoe to come into close contact with the foot by opening the intake/discharge valve after the insertion of the foot. On the other hand, when taking off the shoe, air is taken in/discharged into/from inside the shoe which is in close contact with the foot using the above-described simple instrument for the intake/discharge valve provided at the intake inlet/outlet of the shoe, and not only the sacs but also the outer layer moves freely with flexibility, and it is thereby possible to simply separate the foot from the shoe.

In addition, since the shoe is configured as described above so as to have a structure without laces, when a user walks or runs wearing the shoes, it is possible to reduce resistance without producing friction with air.

Moreover, with the configuration without laces, that is, a simple configuration with no metal fitting to pass the laces, it is possible to realize such a shoe with a structure having excellent light-weight properties.

Furthermore, it is also possible to produce new effects using the characteristic of loosening the valve of the intake inlet/outlet, discharging the gas in the sacs and causing the structural part of the shoe to come into close contact with the foot. That is, since the structure of the shoe corresponds to body organs including at least one of the muscle, skeletal frame, nerve, blood vessel, meridian, reflexology, endocrine organ and other body organs, it is possible to freely set whether or not the structure of the shoe has an effect on the various body organs. For example, if the shoe structure is configured into a shape that stimulates acupuncture points by providing protrusions on the sacs or outer layer disposed at positions corresponding to the acupuncture points, the above-described various acupuncture points are stimulated by putting on the shoe of the present invention. When it is preferred not to squeeze blood vessels or nerves, the structure of the shoe such as the sacs and the outer layer of the shoe may be configured into a shape that avoids the blood vessels or nerves.

Moreover, conversely, new effects may also be produced on outside the sacs and the outer layer of the shoe. That is, since the structure of the shoe corresponds to body organs including at least one of the muscle, skeletal frame, nerve, blood vessel, meridian, reflexology, endocrine organ and other body organs, if the structure of the shoe is made of an extensible material such as a planar fastener (magic tape (registered trademark)) or an adhesive material, it is also possible to efficiently provide an extension function outside the shoe. It is possible to freely set whether or not the structure of the shoe has an effect on the various body organs also for the outside.

Advantageous Effects of Invention

Since the present invention is configured as described above, based on such modal features that the shoe body is provided with an intake inlet/outlet for filling the sacs in the shoe body with an air-like gas, an intake/discharge valve for preventing an outflow of the gas from the sacs is provided at the intake inlet/outlet, and the intake/discharge valve of the intake outlet is opened to remove the gas after the insertion of the foot, the sacs or shoe outer layer are/is caused to contract so as to come into close contact with the foot, it is possible to provide functionality and ease of wearing resulting from preventing untying of the laces, save time and effort required to retie the laces, further reduce air resistance and additionally use the intake/discharging of the gas from inside or outside the shoe with excellent convenience.

The shoe having such a configuration is effectively applicable not only to various sports fields such as field and track running shoes, racing shoes and soccer shoes, but also to normal shoes such as cloth shoes and leather shoes, and other shoes used daily such as rain shoes and safety shoes.

In addition, since its structure is not complicated and configured of a relatively small number of parts, the shoe can be manufactured simply and at low cost.

Moreover, since the structure of the shoe corresponds to body organs including at least one of the muscle/skeletal frame/blood vessel/nerve/meridian/reflexology/endocrine organ and other body organs of the foot, it is possible to freely set whether or not the structure of the shoe has an effect on the body organs, for example, if the shoe structure is configured into such a shape that stimulates acupuncture points by providing protrusions on the sacs or the outer layer made of a stretchable material disposed at positions corresponding to the acupuncture points, the above-described various acupuncture points are stimulated by putting on the shoe of the present invention, and the effects of alleviation of fatigue of the foot, and maintenance and improvement of health can be expected.

Furthermore, if the structure of the shoe corresponding to the above-described body organs is made of an extensible material such as a planar fastener (magic tape (registered trademark)) or an adhesive material, it is also possible to efficiently provide an extension function for the shoe. For example, also when a protector is provided for protection, the protector can be set only at a necessary location.

Similarly, since the structure of the shoe corresponds to the body organs, if a disposable heating pad is attached by way of an extensible material, it is possible to efficiently warm the body and the effects of alleviation of fatigue of the foot, and maintenance and improvement of health can be expected. Thus, when the above-described structure is made of an extensible material such as a planar fastener, it is possible to efficiently attach or detach a necessary number of various members at only necessary locations.

DESCRIPTION OF EMBODIMENTS

Figure 1A:
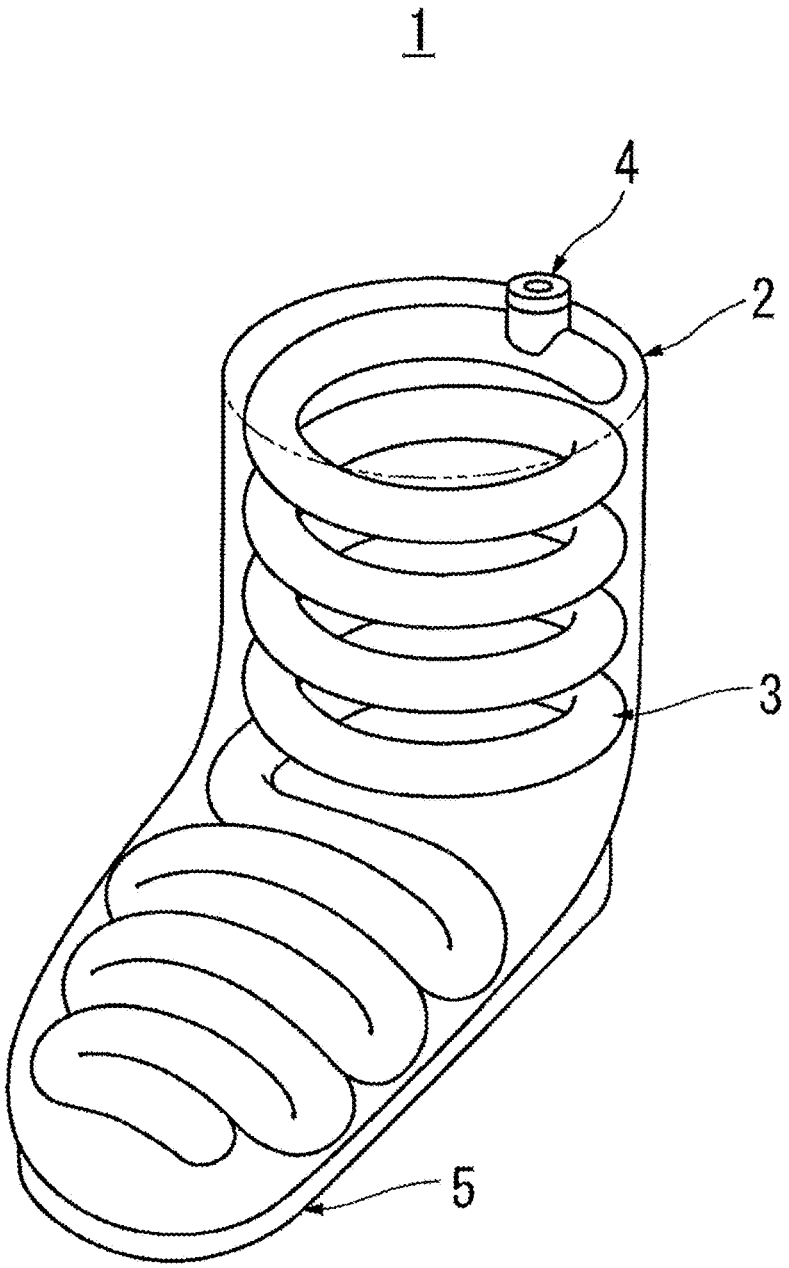
FIGS. 1A and 1B are each a perspective view illustrating an overall image of an easily wearable shoe according to an embodiment of the present invention.
Figure 1B:
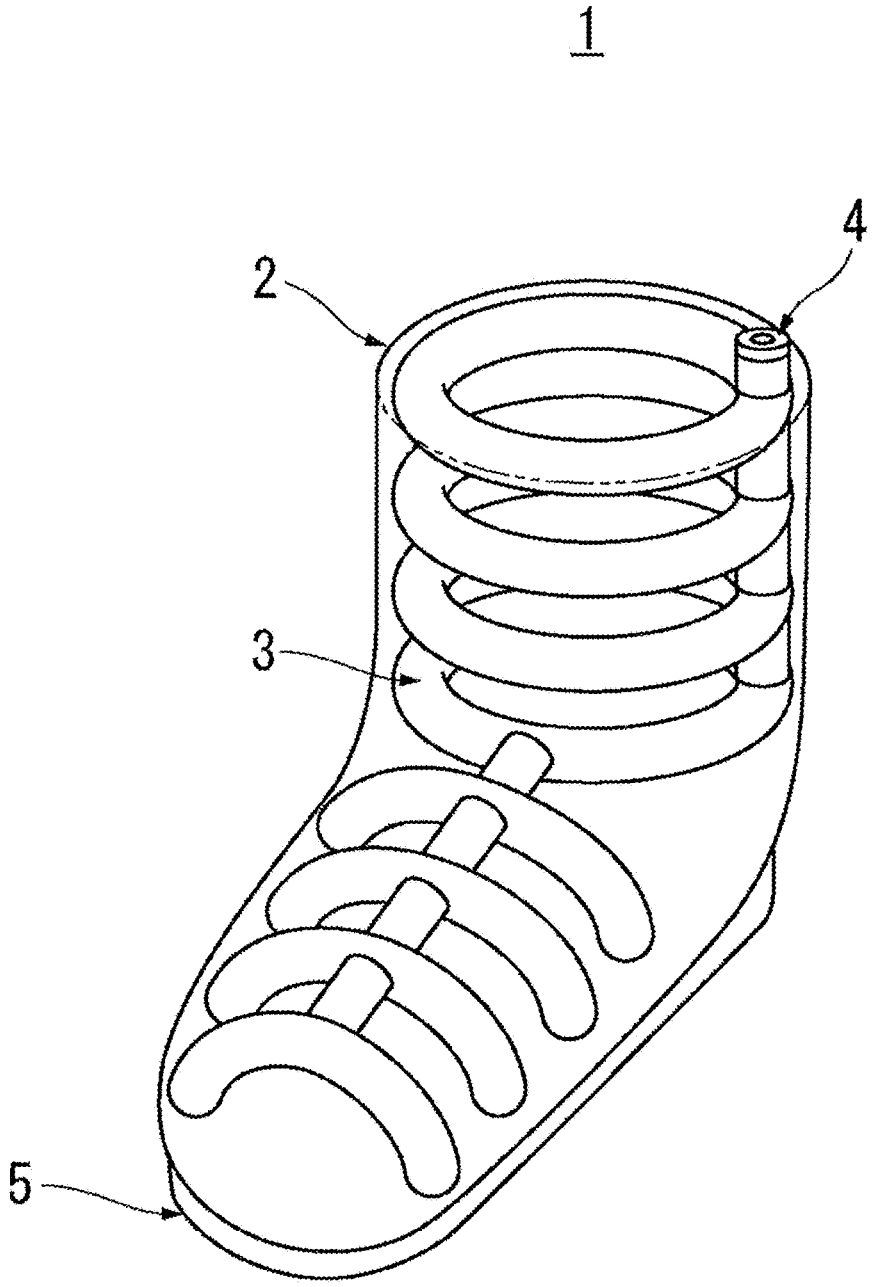

Hereinafter, the best mode for carrying out the present invention will be described with reference to FIGS. 1A and 1B. FIGS. 1A and 1B are each a perspective view illustrating an overall image when the foot is inserted. As shown in FIGS. 1A and 1B, a shoe body 1 according to an embodiment of the present invention is configured to include a shoe base part 5, an outer layer 2, sacs 3 mainly made of a stretchable material and an intake inlet/outlet 4.

When the foot is inserted, an air-like gas is taken into the sacs 3 via an intake/discharge valve (not shown) of the intake inlet/outlet 4, and since the sacs 3 and the outer layer 2 are flexible, the shoe is configured to be stretched up to facilitate the insertion of the foot. FIG. 1A shows an example where the sacs 3 are spirally arranged and joined inside the outer layer 2. FIG. 1B shows an example where the doughnut-shaped sacs 3 are arranged and joined in a chained form.

As described above, when the gas is taken in into the sacs 3, there can be various shapes into which the sacs 3 and the outer layer 2 are arranged so as to facilitate stretching out of the outer layer with flexibility, all of which are included in the inventive concept of the present invention.

Figure 2A:
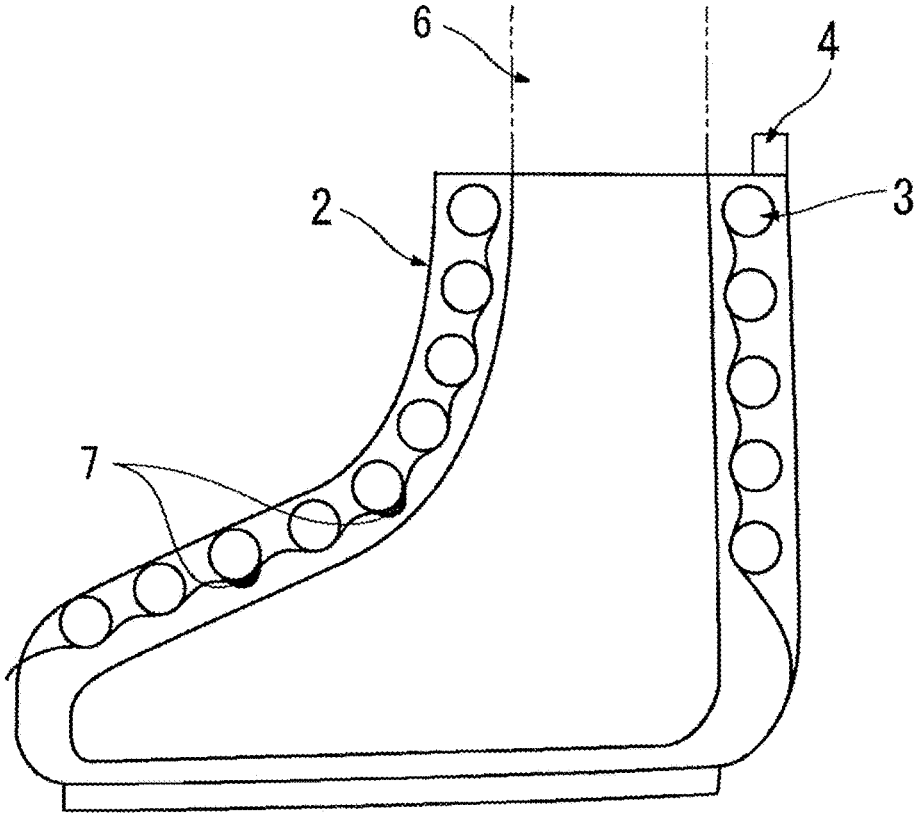
FIGS. 2A and 2B are each a longitudinal cross-sectional view of the shoe in FIGS. 1A and 1B when the foot is inserted in the shoe body.
Figure 2B:
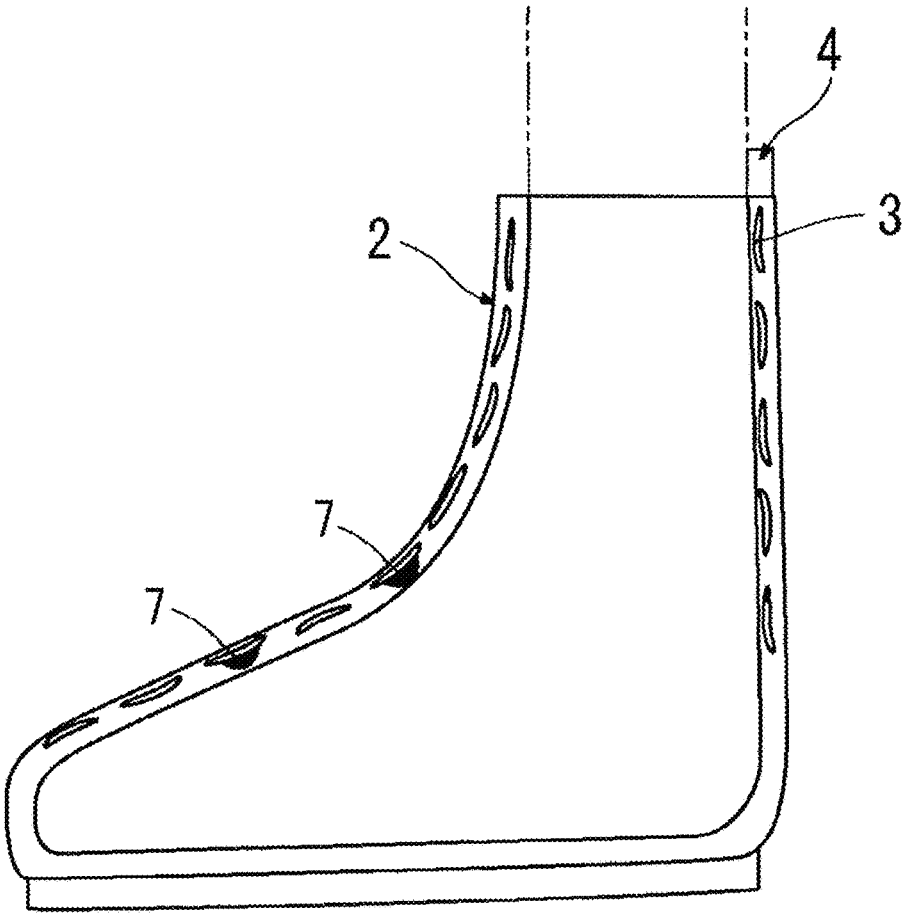

FIGS. 2A and 2B each are aa diagram illustrating when the easily wearable shoe according to the embodiment of the present invention is put on. In FIG. 2A, a gas is taken in into the sacs 3, and the sacs and the outer layer thereby acquire flexibility to stretch out the outer layer 2 and facilitate the insertion of a foot 6.

FIG. 2B illustrates a case where the intake/discharge valve of the intake inlet/outlet 4 is loosened and the gas in the sacs 3 is discharged, and since the inner gas of the sacs 3 is discharged, the sacs 3 and the outer layer 2 contract and both come into close contact with the foot.

Figure 3:
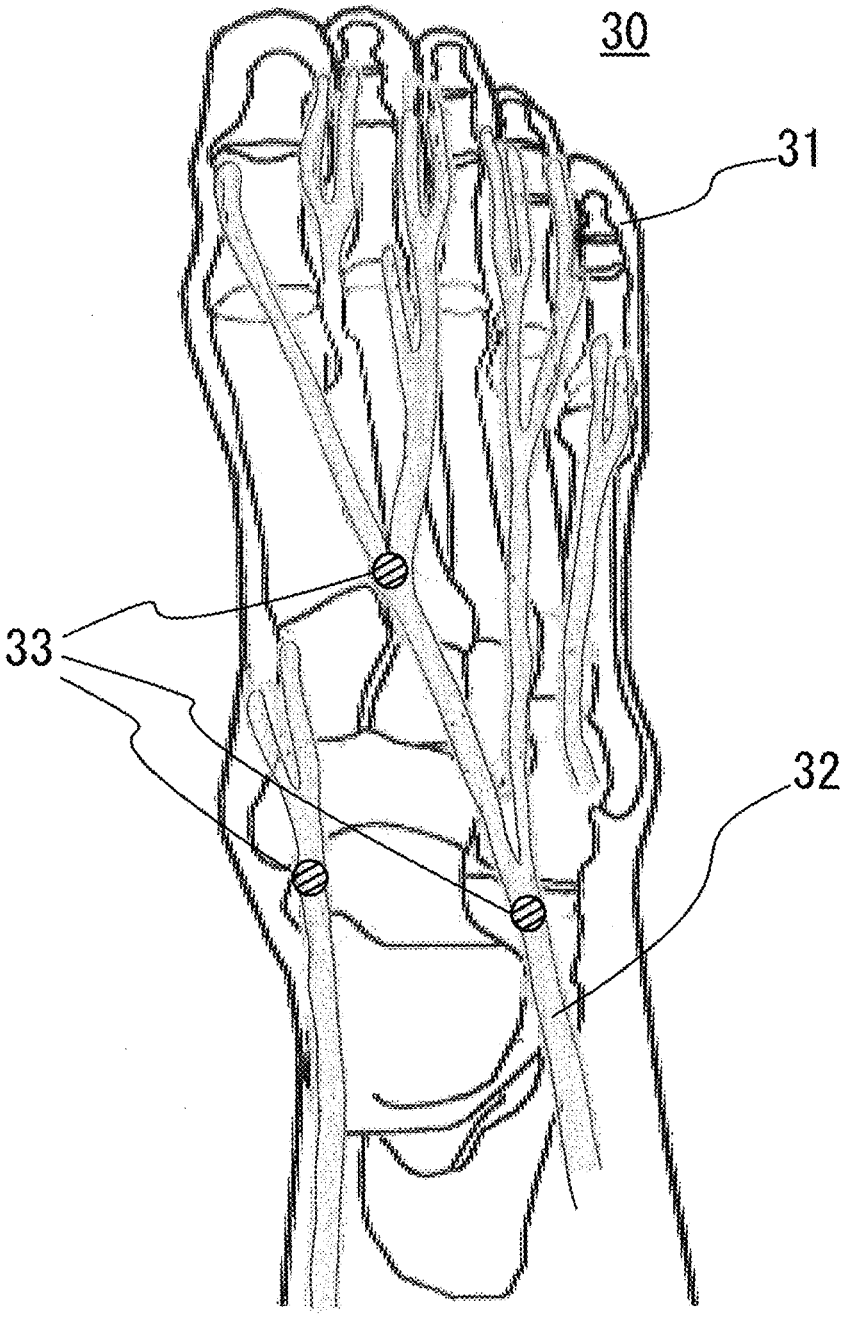
FIG. 3 is a plan view illustrating a nerve tissue along a skeletal frame and acupuncture points of the nerve tissue.

That is, protrusions 7 are provided on a surface of the sacs 3 or a back (not shown) of the outer layer 2, and FIG. 3 shows an example of positions of the protrusions. FIG. 3 illustrates a nerve tissue 32 along a skeletal frame 31 of a foot 30 and the protrusions 7 are provided on the surfaces of the sacs or the back of the outer layer at positions corresponding to several acupuncture points 33 of the nerve tissue.

The intake/discharge valve of the intake inlet/outlet 4 in FIGS. 1A and 1B is a check valve, but any type of valves may be used when a simple instrument is connected to or integrated with the shoe in advance to charge an air-like gas into the sacs 3, as long as the gas is never discharged and the sacs 3 which are mainly made of a stretchable material extend or contract caused by loosening of the valve, the sacs 3 are squeezed and the gas is discharged from the valve. However, the valve is preferably one that has a simple structure and is light-weighted.

The intake inlet/outlet 4 provided with such a valve may be disposed at any position such as a vertex or side of the shoe body 1.

Note that the intake inlet/outlet 4 and the intake/discharge valve may be integrally formed of a material having certain rigidity such as synthetic resin or metal or may be formed by combining parts generated using partially identical or different materials.

As described so far, the easily wearable shoe according to the present invention takes in a gas into the sacs to thereby allow the foot to be inserted, loosens the intake/discharge valve of the intake inlet/outlet to discharge the gas, and can thereby cause the shoe to come into close contact with the foot. Furthermore, since the shoe according to the present invention fixes the foot to the shoe without using laces, it is possible to avoid disadvantages of the shoe having laces. Moreover, the structure with no laces can keep anti-air resistance high. Furthermore, these can be implemented with a relatively simple structure.

Therefore, since no laces are used, the present invention can fully secure and take advantage of the functionality and ease of wearing with no possibility that laces may be untied, save time and effort required to retie the laces and convenience of taking-in/discharging the air from inside or outside the shoe. Furthermore, the air resistance can be significantly reduced compared to shoes with laces. Furthermore, it is possible to keep high convenience of taking-in/discharging the air from inside or outside the shoe. In addition, the shoe can be manufactured at low cost.

Figure 4:
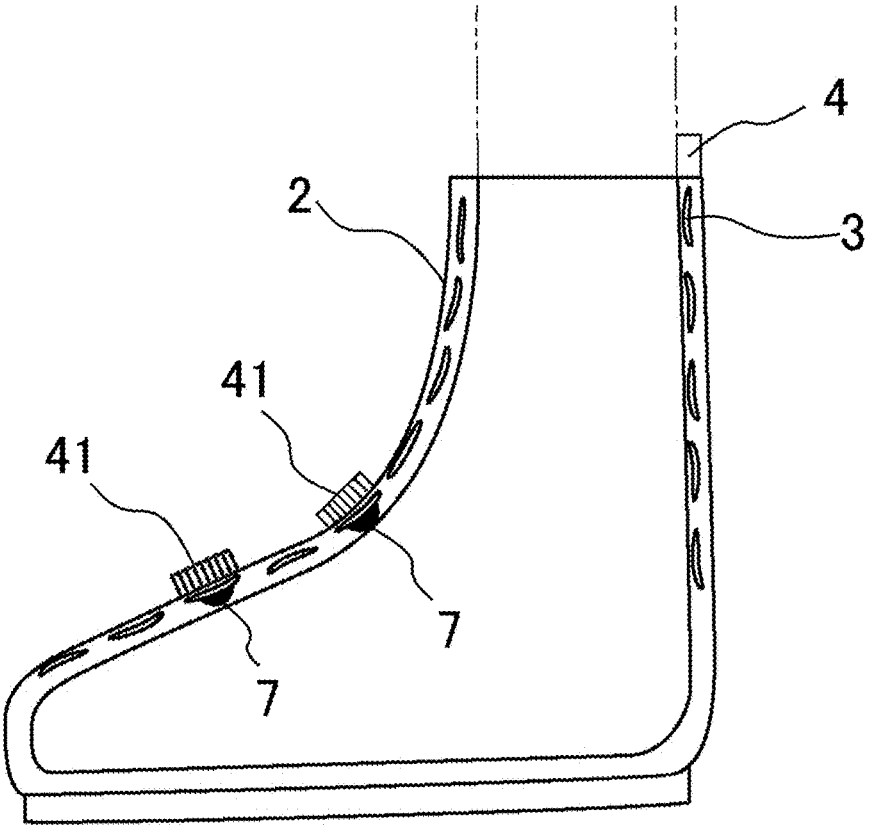
FIG. 4 is a longitudinal cross-sectional view of an extensible member such as a planar fastener attached to the structure of the shoe (outer layer/inner sacs).

FIG. 4 illustrates an example where positions of the outer layer 2 corresponding to the muscle, skeletal frame, blood vessel, nerve, meridian, reflexology, endocrine organ and other body organs of the foot are made of an extensible material such as a planar fastener 41 or adhesive tape. Of course, the planar fastener may be continuously attached.

Figure 5:
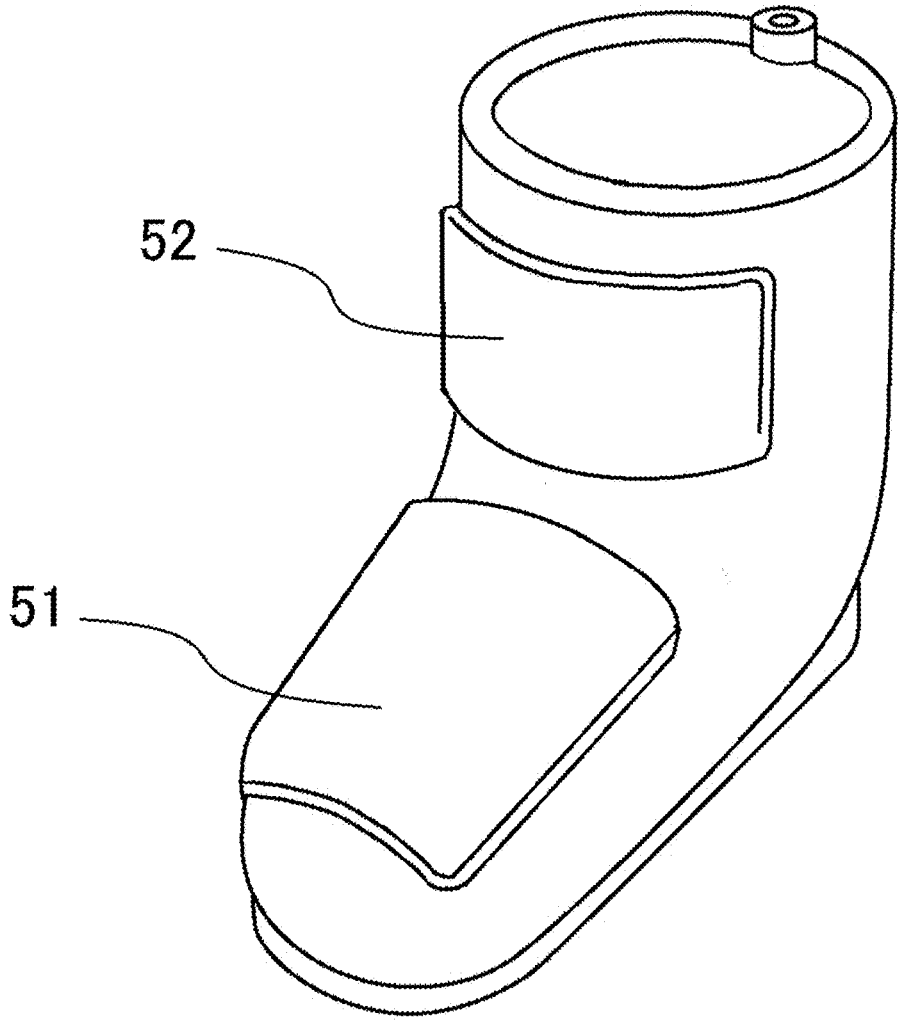
FIG. 5 is a perspective view of the shoe to which a protector using an extensible material such as a planar fastener is attached.

FIG. 5 is a perspective view of a shoe having a protector 51 attached for protecting the positions corresponding to the above-described body organs, the protector being attached to regions made of an extensible material such as the above-described planar fastener or adhesive tape. Moreover, the present invention can also be applied to a case where a disposable heating pad is added to a position of a necessary acupuncture point using the above-described planar fastener or the like to effectively prevent chilling of the foot or stimulate acupuncture points. Of course, by adding the planar fastener 41 to the shin of the foot as well, it is possible to attach a protector 52 or disposable heating pad to the part of the acupuncture point of the shin.

Note that the present invention is not limited to the aforementioned embodiment, but various modifications, additions, substitutions, expansions, contractions or the like to the aforementioned embodiment are acceptable without departing from the identical or equivalent scope of technical ideas thereof. For example, those disposed in correspondence with the aforementioned muscle, skeletal frame, blood vessel, nerve, meridian, reflexology, endocrine organ and other body organs may be base parts widely associated with the structure of the shoe including the outer layer and/or inner sacs.

Furthermore, for example, the technical idea of the present invention has been described above as the shoe as a single unit, but the present invention may also be implemented as a coating device in which these coating instruments are collectively formed, and the present application includes these embodiments as well.

INDUSTRIAL APPLICABILITY

The easily wearable shoe according to the present invention allows the foot to be inserted quite simply, loosens the valve to remove the air to cause the shoe to instantaneously come into contact with the foot, thus making it possible to save time and effort required to tie or untie laces as shoes for senior citizens, significantly improve ease of use, reduce air resistance, and therefore the shoe according to the present invention is applicable to various sports fields and effectively applicable to various industries including the sports goods industry.

Furthermore, since the structure is not complicated and configured of a relatively small number of parts, the shoe can be manufactured simply and at low cost, and can therefore be widely used in the field of all kinds of footwear or the like.

Taking advantage of characteristics of ease of wearing through taking-in/discharging the air and the correspondence to body organs, which are the features of the present invention, the present invention can not only be applied to shoes but also be widely developed and applied to clothes and outfits.

REFERENCE SIGNS LIST

1 Shoe body
2 Outer layer
3 Sacs
4 Intake inlet/outlet
5 Shoe base part
6 Foot
7 Protrusion
30 Foot
31 Skeletal frame
32 Nerve tissue
33 Acupuncture point
41 Planar fastener
51, 52 Protector

The invention claimed is:

1. A shoe comprising:

an outer layer that covers a foot, the outer layer being composed of flexible material which enables the outer layer to be stretched out or to be contracted;

an inner sac disposed inside the outer layer and being composed of flexible material which enables the inner sac to be stretched out or to be contracted;

a gas intake/discharge valve that takes in/takes off air against the inner sac, the gas intake/discharge valve being a check valve; and protrusions provided on a surface of the inner sac or a back of the outer layer and disposed at positions consisting of positions corresponding to acupuncture points of the foot or disposed at positions consisting of three protrusions, the protrusions being configured to push the acupuncture points to be relatively stronger than non-acupuncture points when the gas intake/discharge valve is opened to remove the air from the inner sac.

2. The shoe according to claim 1, wherein said outer layer and said inner sac are made of an extensible material.

* * * * *